US007963592B1

(12) United States Patent
Stanley

(10) Patent No.: US 7,963,592 B1
(45) Date of Patent: Jun. 21, 2011

(54) LAWN CHAIR

(76) Inventor: Jennifer K. Stanley, Tobaccoville, NC (US)

( * ) Notice: Subject to any disclaimer, the term of this patent is extended or adjusted under 35 U.S.C. 154(b) by 90 days.

(21) Appl. No.: 12/417,347

(22) Filed: Apr. 2, 2009

(51) Int. Cl.
*A47C 4/00* (2006.01)
*A47C 4/20* (2006.01)
*A47C 4/28* (2006.01)
*A47C 7/62* (2006.01)

(52) U.S. Cl. ..... 297/31; 297/188.04; 297/188.08; 297/452.63; 297/900

(58) Field of Classification Search ..... 297/900, 297/452.63, 31, 188.04, 188.08
See application file for complete search history.

(56) References Cited

U.S. PATENT DOCUMENTS 2,615,501 A * 10/1952 Neiborn ..... 297/153
3,094,358 A * 6/1963 Hartman ..... 297/452.64
3,186,757 A * 6/1965 Hopkins ..... 297/28
3,624,814 A * 11/1971 Borichevsky ..... 297/82
4,421,358 A * 12/1983 Lehnen ..... 297/411.4
4,606,086 A 8/1986 Rowland
4,773,708 A 9/1988 Nastu
4,789,200 A 12/1988 Munguia
4,891,854 A 1/1990 Finkelstein
4,941,222 A * 7/1990 Prager ..... 5/111
5,121,969 A * 6/1992 Schroeder ..... 297/397
D335,397 S 5/1993 Fox
5,222,779 A * 6/1993 Johnson ..... 297/900 X
5,297,850 A 3/1994 Guleserian
5,350,215 A * 9/1994 DeMars ..... 297/188.14
D352,635 S * 11/1994 Yoder ..... D6/611
5,946,749 A 9/1999 Sewell
6,042,184 A * 3/2000 Kofoed ..... 297/900 X
6,059,365 A * 5/2000 Diamond ..... 297/354.13
6,068,342 A * 5/2000 Mariani et al. ..... 297/219.1
6,109,685 A * 8/2000 Lindsey et al. ..... 297/40
6,860,567 B1 * 3/2005 Bauer ..... 297/900 X
6,938,287 B1 * 9/2005 Mahshie ..... 297/900 X
7,207,622 B2 * 4/2007 Cohan et al. ..... 297/31
7,703,854 B2 * 4/2010 LaFreniere ..... 297/411.23

* cited by examiner

*Primary Examiner* — Rodney B White
*Assistant Examiner* — Joseph Edell
(74) *Attorney, Agent, or Firm* — Crossley Patent Law; Mark A. Crossley

(57) ABSTRACT

A improved lawn chair that is designed to allow an individual to more easily lie on one's stomach while resting on the lawn chair, and furthermore, provide components to enable one to store sunbathing accessories. The lawn chair is fabricated from an aluminum framework and vinyl strapping and includes an oval-shaped head cutout, which allows an individual to rest on their stomach, with their head placed face-down over the head cutout area. The lawn chair also includes a reading rack and an attached multi-compartment pouch.

1 Claim, 6 Drawing Sheets

FIG. 1

LAWN CHAIR

BACKGROUND OF THE INVENTION

The present invention concerns that of a new and improved lawn chair that is designed to allow an individual to more easily lie on one's stomach while resting on the lawn chair, and furthermore, provide components to enable one to store sunbathing accessories.

SUMMARY OF THE INVENTION

The present invention concerns that of a new and improved lawn chair that is designed to allow an individual to more easily lie on one's stomach while resting on the lawn chair, and furthermore, provide components to enable one to store sunbathing accessories. The lawn chair is fabricated from an aluminum framework and vinyl strapping and includes an oval-shaped head cutout, which allows an individual to rest on their stomach, with their head placed facedown over the head cutout area. The lawn chair also includes a reading rack and an attached multi-compartment pouch.

There has thus been outlined, rather broadly, the more important features of a lawn chair that the detailed description thereof that follows may be better understood and in order that the present contribution to the art may be better appreciated. There are, of course, additional features of the lawn chair that will be described hereinafter and which will form the subject matter of the claims appended hereto.

In this respect, before explaining at least one embodiment of the lawn chair in detail, it is to be understood that the lawn chair is not limited in its application to the details of construction and to the arrangements of the components set forth in the following description or illustrated in the drawings. The lawn chair is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present lawn chair. It is important, therefore, that the claims be regarded as including such equivalent constructions insofar as they do not depart from the spirit and scope of the present invention.

It is therefore an object of the present invention to provide a lawn chair which has all of the advantages of the prior art and none of the disadvantages.

It is another object of the present invention to provide a lawn chair which may be easily and efficiently manufactured and marketed.

It is another object of the present invention to provide a lawn chair which is of durable and reliable construction.

It is yet another object of the present invention to provide a lawn chair which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
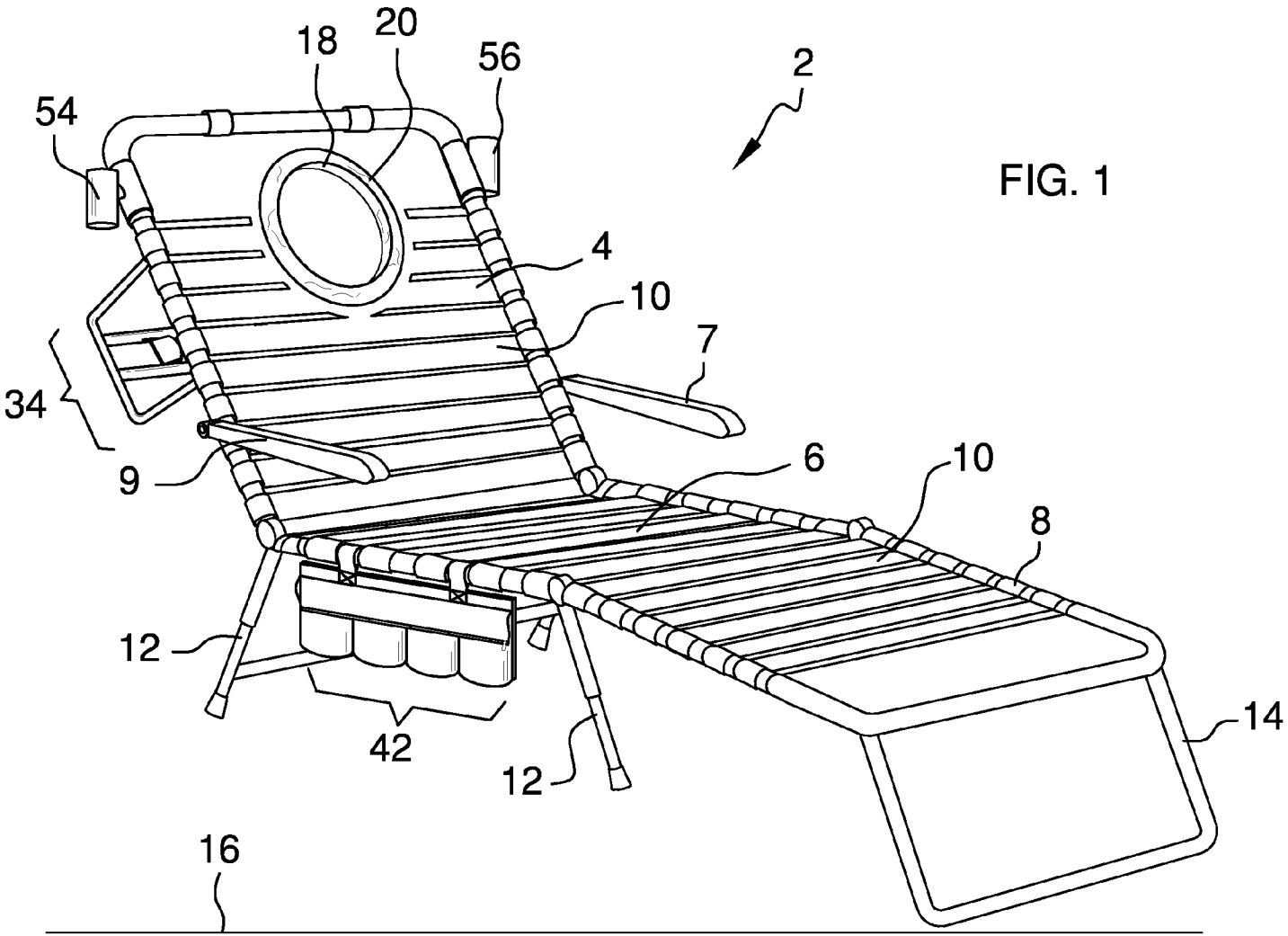
FIG. 1 shows a front perspective view of the lawn chair as it would appear in use.
Figure 2:
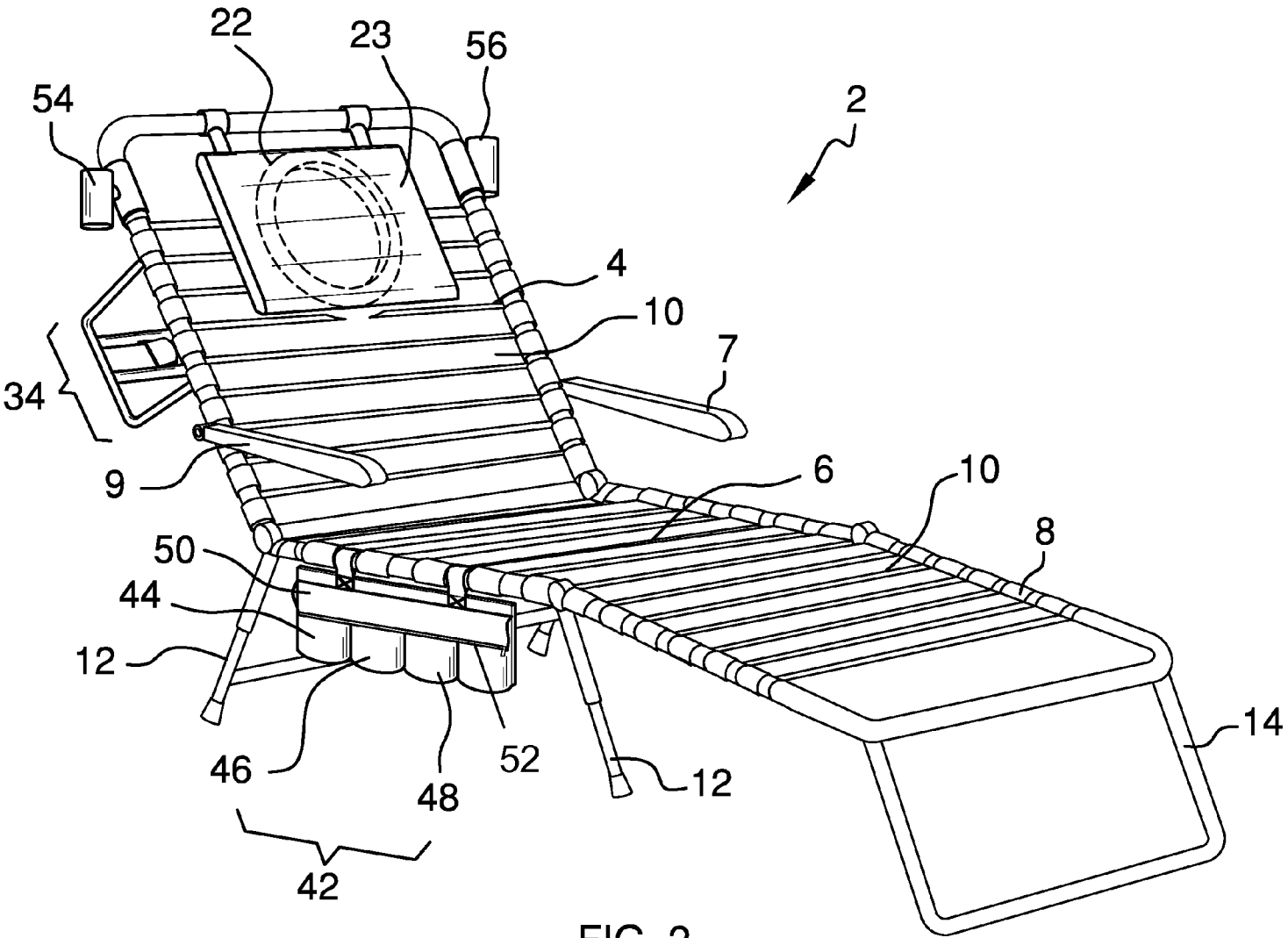
FIG. 2 shows a front perspective view of the lawn chair as it would appear in use with a pillow ring cover located over the head cutout.
Figure 3:
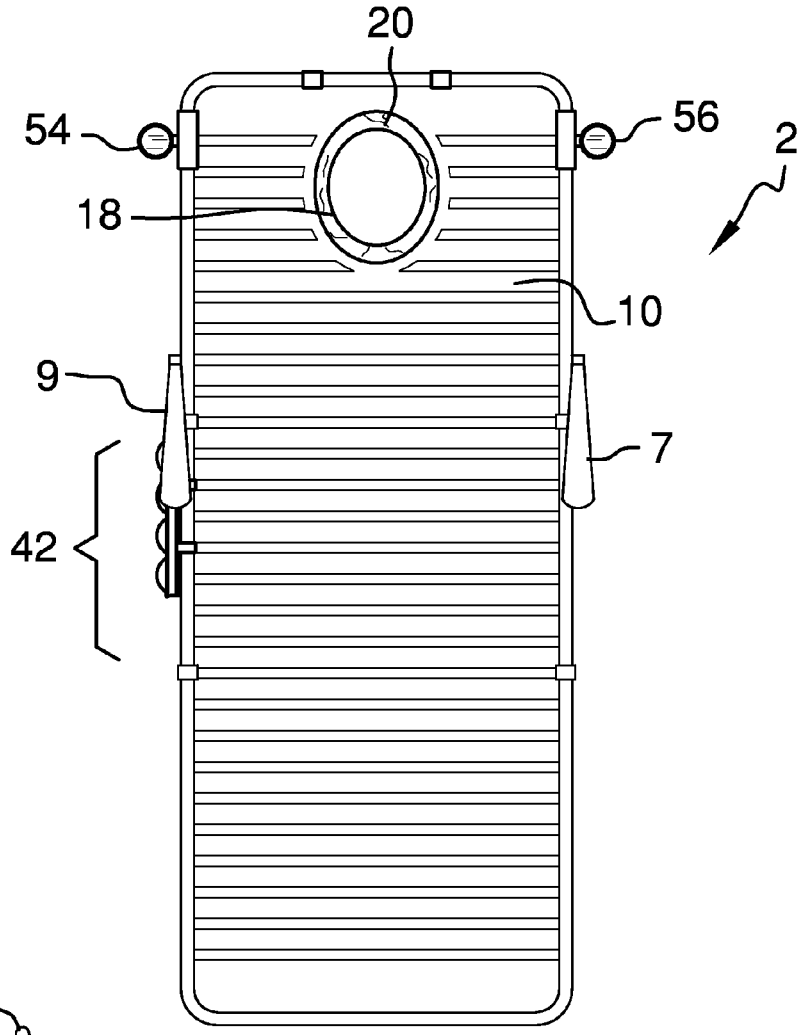
FIG. 3 shows a top view of the lawn chair as it would appear in use.
Figure 4:
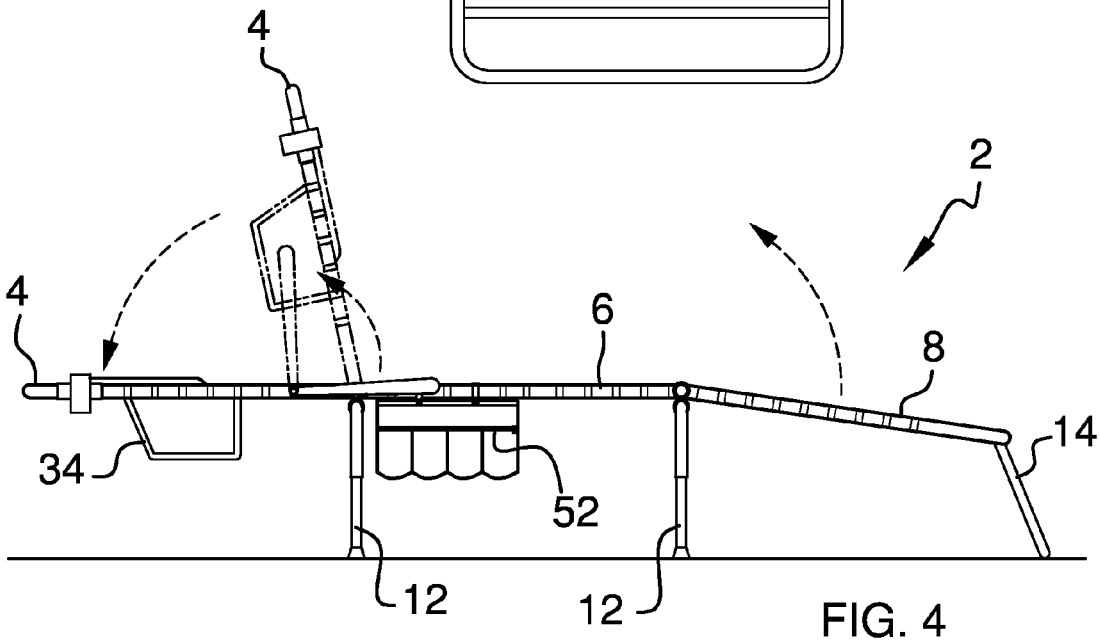
FIG. 4 shows a side view of the lawn chair as it would appear in use.
Figure 5:
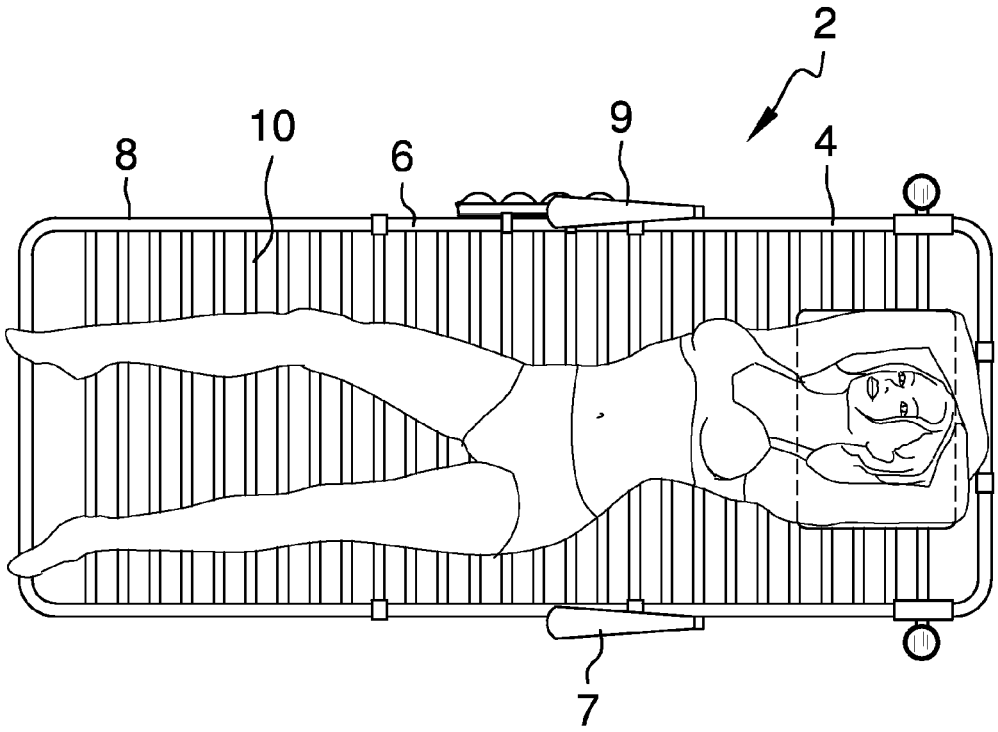
FIG. 5 shows a top view of the lawn chair as it would appear in use with an individual located on the lawn chair.
Figure 6:
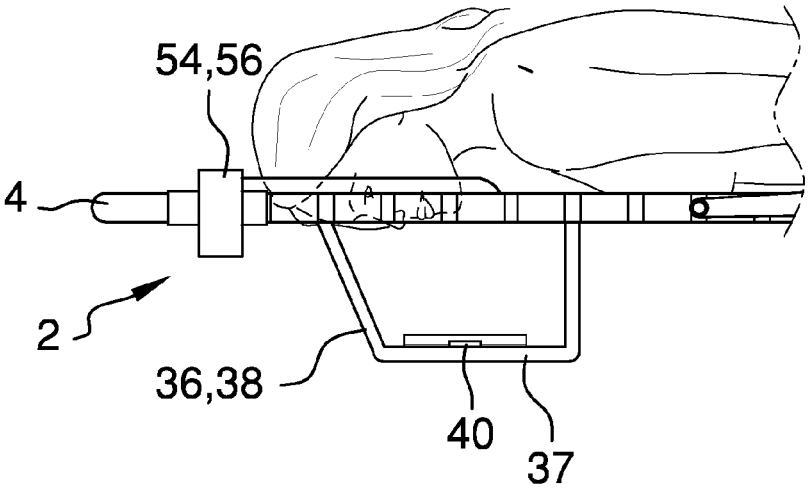
FIG. 6 shows a side view of the lawn chair as it would appear in use with an individual located on the lawn chair.
Figure 7:
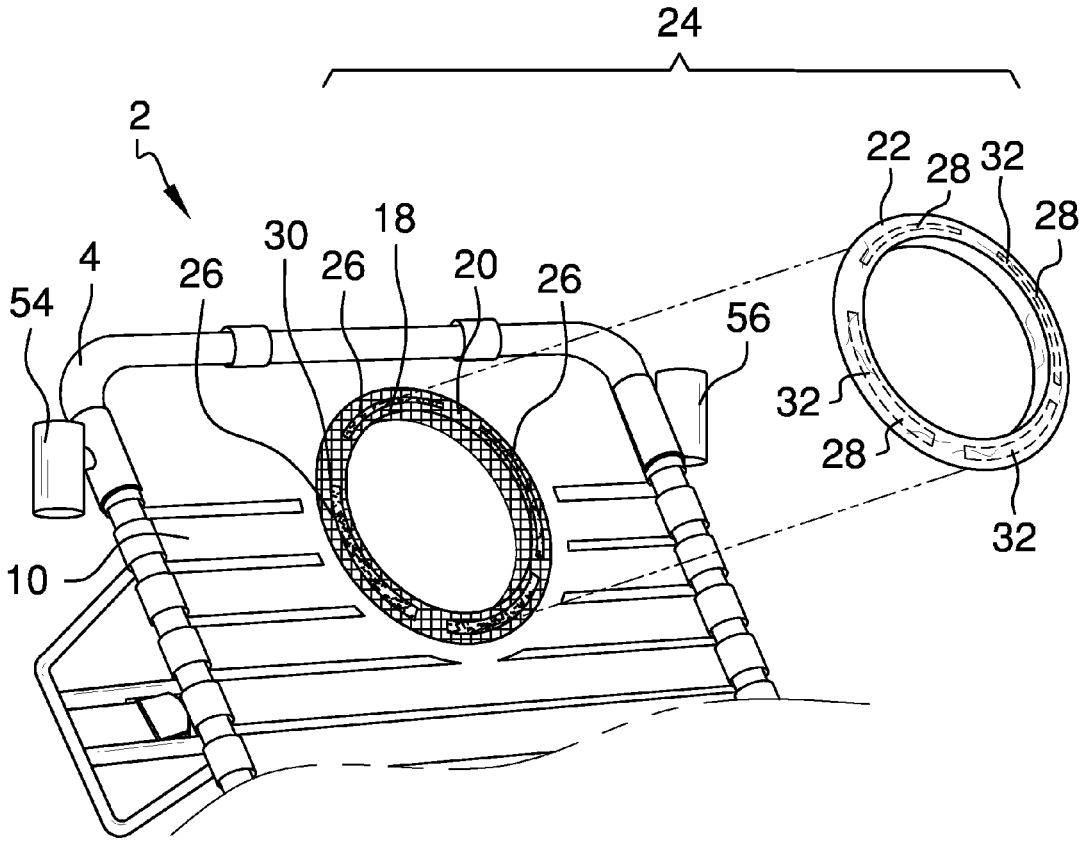
FIG. 7 shows a front perspective close-up view of the lawn chair as it would appear in use, highlighting the placement of the head cutout ring cover.
Figure 8:
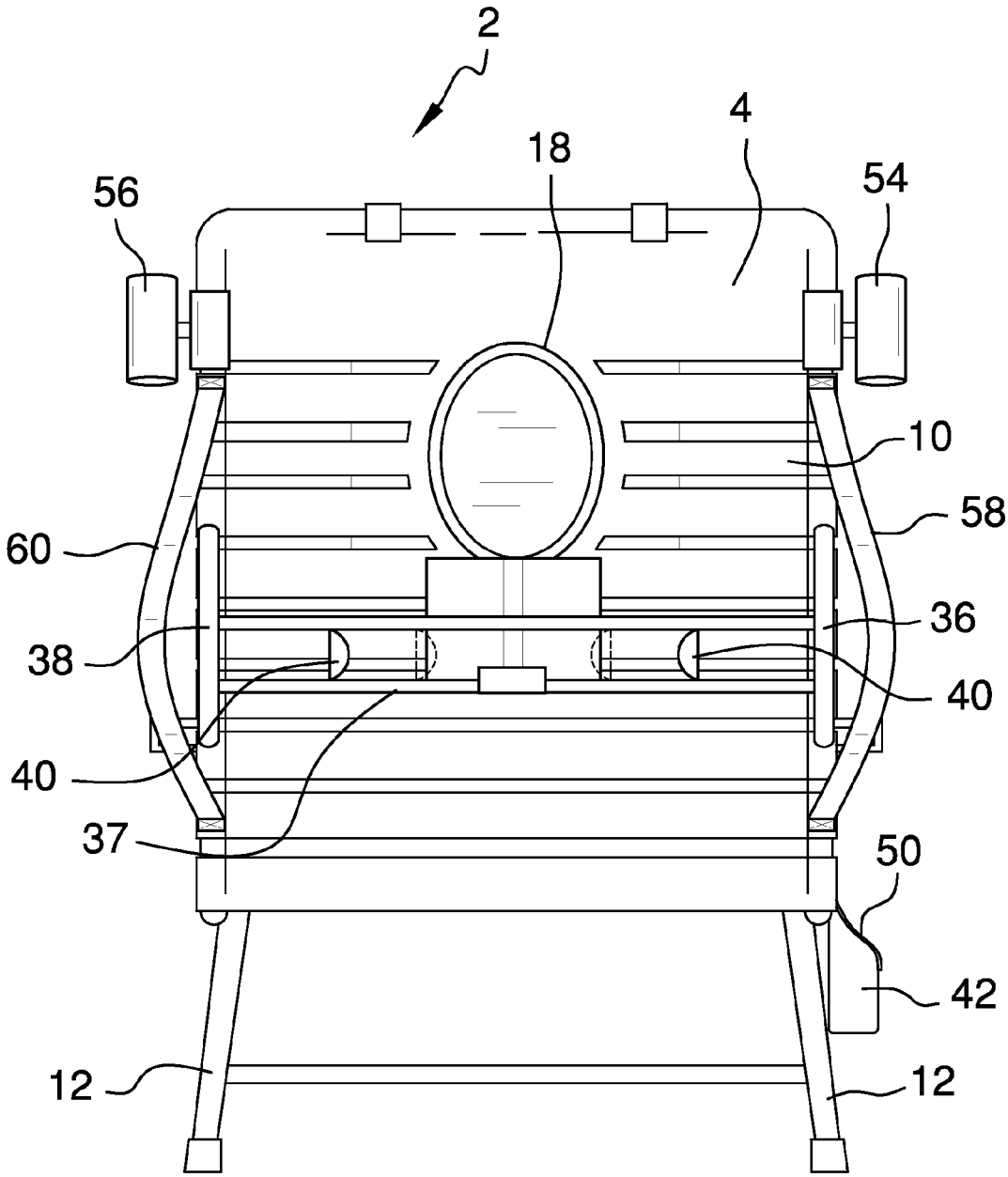
FIG. 8 shows a rear view of the lawn chair as it would appear in use.

With reference now to the drawings, and in particular to FIGS. 1 through 8 thereof, a lawn chair embodying the principles and concepts of the present invention and generally designated by the reference numeral 2 will be described.

As best illustrated in FIGS. 1 through 8, the lawn chair 2 comprises three sections comprising an upper body portion 4, a middle body portion 6, and a lower body portion 8. The upper body portion 4 is pivotally attached to the middle body portion 6, while the lower body portion 8 is pivotally attached to the middle body portion 6. A pair of adjustable arms 7 and 9 are pivotally attached to the upper body portion 4 of the lawn chair.

A plurality of vinyl straps 10 are attached to each of the body portions 4, 6, 8. The vinyl straps 10 are placed to provide structure for the lawn chair 2 and also to provide a support mechanism for an individual while they are using the lawn chair 2. Furthermore, the lawn chair 2 further comprises a quartet of support stands 12 attached to the middle body portion 6 of the lawn chair 2 and an end support 14 that is attached to the lower body portion 8. The support stands 12 and the end support 14 are used to support the lawn chair 2 on a ground surface 16 when the lawn chair 2 is in use.

The upper body portion 4 of the lawn chair 2 has a centrally-located hole 18 and is surrounded by an amount of padding 20. A ring cover 22 can be placed over the padding 20 for extra comfort when in use, and at the same time, an included towel 23 can be placed over the hole 18 and padding 20 when the hole 18 is not in use.

The ring cover 22 is removably attached to the padding 20 through the use of a hook and loop attachment system 24. The system 24 includes a plurality of first patches 26 attached to the padding 20 and a plurality of second patches 28 attached to the ring cover 22. Each first patch 26 has a plurality of first attachment objects 30 on it, while each second patch 28 has a plurality of second attachment objects 32 on it. One of the plurality of attachment objects comprises a plurality of hooks, while the other plurality of attachment objects comprises a plurality of loops.

The lawn chair 2 also includes a reading rack 34 that is affixed to the upper body portion 4 of the lawn chair 2. The reading rack 34 is attached to the upper body portion 4 by a pair of telescoping rods 36 and 38, allowing the reading rack 34 to be adjusted as needed. A support board 37 is attached to each of the telescoping rods 36 and 38, with a clip 40 also attached being associated with the support board 37. The clip 40 is used to hold down pages of a book or magazine while the book and/or magazine is being read. The reading rack 34 is positioned so as to allow an individual lying face down on the lawn chair to see the reading rack 34 through the hole 18 on the upper body portion 4.

A multi-compartment pouch 42 is also attached to the middle body section 6 of the lawn chair 2. The pouch 42 preferably has three separate compartments 44, 46, 48 that can be covered with a flap 50. The flap 50 on the compartments 44, 46, 48 can be closed over the compartments 44, 46, 48 by a zipper 52.

The lawn chair 2 further comprises a pair of umbrella holders 54 and 56 that are affixed to the upper body portion 4 of the lawn chair 2. Furthermore, the lawn chair 2 comprises a pair of carry straps 58 and 60, which are attached to one of the body portions of the lawn chair 2. The carry straps 58 and 60 will allow an individual to carry the lawn chair 2 when it is folded up and not in use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A lawn chair comprising a plurality of body portions comprising an upper body portion, a middle body portion, and a lower body portion, wherein the upper body portion is pivotally attached to the middle body portion, further wherein the lower body portion is pivotally attached to the middle body portion;

a pair of adjustable arms comprising a first adjustable arm and a second adjustable arm, wherein each of the adjustable arms are pivotally attached to the upper body portion;

a plurality of vinyl straps, wherein some of the plurality of vinyl straps are attached to each of the body portions of the plurality of body portions;

a plurality of supports stands, wherein each support stand of the plurality of support stands are attached to the middle body portion;

an end support, wherein the end support is attached to the lower body portion;

a hole located in the upper body portion, (ii) an amount of padding circumferentially surrounding the hole;

a plurality of first patches, wherein each first patch is attached to the padding;

a plurality of second patches, wherein each second patch is attached to a ring cover;

a first plurality of attachment objects, wherein some of the first plurality of attachment objects are attached to each first patch of the plurality of first patches;

a second plurality of attachment objects, wherein some of the second plurality of attachment objects are attached to each second patch of the plurality of second patches;

wherein one of the plurality of attachment objects comprises a plurality of hooks;

further wherein the remaining plurality of attachment objects comprises a plurality of loops;

further wherein placing a first patch into contact with a second patch causes the first patch and the second patch to become removably attached to one another;

a reading rack, the reading rack further comprising (i) a pair of telescoping rods comprising a first telescoping rod and a second telescoping rod, wherein each of the telescoping rods are attached to the upper body portion, (ii) a support board attached to each of the telescoping rods of the pair of telescoping rods, (iii) at least one clip associated with the support board, (iv) wherein the reading rack is placed so as to allow an individual lying facing down to have the reading rack within their view through the hole in the upper body portion, a pouch, wherein the pouch is attached to the middle body portion, wherein the pouch further comprises a plurality of compartments associated with the pouch, a flap attached to the pouch, a zipper associated with the flap, wherein the zipper can be used to removably attached the flap over the plurality of compartments, at least one umbrella holder, wherein the umbrella holder is attached to the lawn chair;

a pair of carry straps comprising a first carry strap and a second carry strap, wherein each of the carry straps is attached to a body portion of the lawn chair.

* * * * *